US011167293B2

(12) United States Patent
Porkert

(10) Patent No.: US 11,167,293 B2
(45) Date of Patent: Nov. 9, 2021

(54) CYCLONE SEPARATOR

(71) Applicant: Ecofario GmbH, Munich (DE)

(72) Inventor: Sebastian Porkert, Breitbrunn am Ammersee (DE)

(73) Assignee: ECOFARIO GmbH, Munich (DE)

( * ) Notice: Subject to any disclaimer, the term of this patent is extended or adjusted under 35 U.S.C. 154(b) by 65 days.

(21) Appl. No.: 16/625,755

(22) PCT Filed: Jun. 22, 2018

(86) PCT No.: PCT/EP2018/066743

§ 371 (c)(1),
(2) Date: Dec. 22, 2019

(87) PCT Pub. No.: WO2018/234539

PCT Pub. Date: Dec. 27, 2018

(65) Prior Publication Data

US 2021/0154685 A1 May 27, 2021

(30) Foreign Application Priority Data

Jun. 22, 2018 (DE) ..... 10 2017 113 888.9

(51) Int. Cl.
*B04C 5/04* (2006.01)
*B04C 5/107* (2006.01)
(Continued)

(52) U.S. Cl.
CPC ..... *B04C 5/04* (2013.01); *B04C 5/107* (2013.01); *B04C 5/13* (2013.01); *B04C 5/181* (2013.01)

(58) Field of Classification Search
CPC ..... B01D 45/16; B01D 45/12; B01D 45/08; B01D 45/06; B04C 5/04; B04C 5/13; B04C 5/107; B04C 5/181
See application file for complete search history.

(56) References Cited

U.S. PATENT DOCUMENTS 3,747,306 A * 7/1973 Wikdahl ..... B04C 5/28 55/349
2010/0069217 A1* 3/2010 Aoki ..... B04C 5/14 494/40

FOREIGN PATENT DOCUMENTS

GB 2427841 * 10/2007
JP 2016019953 * 2/2016

OTHER PUBLICATIONS

Machine translation of JP2016019953, (2016) by Yoshiya Yamanaka et al. obtained from JPO Apr. 2021 (Year: 2016).*

* cited by examiner

*Primary Examiner* — Robert Clemente
*Assistant Examiner* — Hafiz Muhammad Aamir
(74) *Attorney, Agent, or Firm* — Douglas Denninger

(57) ABSTRACT

A cyclone separator for separating at least two phases of a fluid, with a base housing through which the fluid can flow in an essentially helical pattern, that has a separation chamber with an upper and a lower end, wherein the upper and lower end each respectively have a wall, and a central axis that extends between the two ends, and furthermore a central separation tube arranged inside the conical separation chamber, concentric to the central axis of the base housing, with an essentially cylindrical wall having a surface facing toward the inner cross-section with a first surface profile, and a surface facing away from the inner cross-section with a second surface profile. The base housing has at its upper end a header section with an inner radius and with at least one essentially tangentially attached inlet opening for the fluid, as well as at least one light fraction outlet opening with a cross-section and, at its lower end, at least one expansion chamber and at least one heavy fraction outlet opening. The separation chamber tapers conically in the direction of the (Continued)

Figure 1:
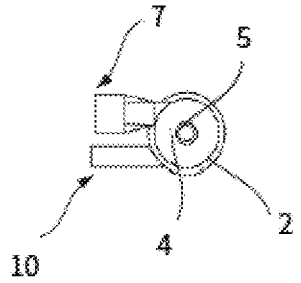

Section B-B lower end at least incrementally in sections, preferably with a constant cone angle $\alpha$.

25 Claims, 6 Drawing Sheets

(51) Int. Cl.
*B04C 5/13* (2006.01)
*B04C 5/181* (2006.01)

Section A-A

Section B-B

CYCLONE SEPARATOR

The present invention concerns a cyclone separator for separating at least two phases of a fluid, as well as an injection mold for producing a base housing, an expansion chamber and/or a stabilizer of a cyclone separator, as well as a use of the inventive cyclone separator for separating at least two phases of a fluid.

Fluids, solids and gases are often polluted with contaminants that differ in density from the medium being cleaned.

These contaminants can be, for example:

- microplastic particles and/or light and/or heavy particles in wastewater treatment plants, process water and/or waste waters;
- microplastic particles and/or light and/or heavy particles in salt water or brackish water as a purification step in the process of desalinization of the salt-containing water;
- microplastic particles and/or light and/or heavy particles in fiber suspensions and process waters from the paper and pulp industry;
- microplastic particles and/or light and/or heavy particles in liquid fluids for general cleaning;
- heavy particles in gas mixtures (e.g aerosols, dusts);
- phased contaminants from oil, or oil components in petrochemically contaminated water.

Numerous studies conducted around the world have shown that microplastic is increasingly building up in the oceans and their sediments, as well as in rivers and inland waters. This is already resulting in microplastic pollution of virtually all aquatic flora and fauna.

The existence of this pollution presents a problem not only due to the presence of polymeric particles that are foreign to organisms, but more significantly due to the disadvantageous chemical properties of these particles. Their material-related hydrophobic properties as well as their large specific surface area give them the ability to adsorb organic pollutants, medication residues and hormones of all sorts. This makes them optimal carriers of substances that are potentially hazardous to humans. Substances that could accumulate may include, amongst other things, carcinogenic toxins, which can end up in humans via the food chain and are suspected of causing disease in humans.

The separation of microplastic particles from industrial process waters and waste waters from wastewater treatment plants confronts current process engineering with a problem that has been virtually impossible to solve. While it is possible using wastewater treatment plants to separate out, to a very high degree, the microplastic fractions with a size>1 mm by means of existing processes, particles with a size<1 mm clearly pose an unsolvable problem for these processes. Numerous studies have shown that a significant portion of the microplastic burden in rivers, lakes and oceans consists of fractions that cannot be separated from wastewater by wastewater treatment plants before the wastewater is discharged. These fractions include primarily abrasive particles from cosmetic products and detergents as well as microscopic fibers from synthetic clothing that enter the wastewater during the washing process. Microplastic particles make up a significant portion of the overall burden in the affected waters.

According to our current state of knowledge, such particles enter the waters mostly via the wastewater treatment plants of industries that actively or passively process plastic. One of these industries is the waste paper processing segment of the paper industry. Plastic is an accompanying substance in the waste paper being processed. Although the plastic is largely separated out in the pulp treatment process, a significant fraction, which is comminuted during the process steps, enters the process water, and subsequently the wastewater treatment plants of the industrial companies.

Aside from their size, one special feature of the microplastic particles present is their specific density which, without exception, is extremely close to the density of water. The minimal difference in specific density between water and the microplastic particles found therein, as well as their size, reflects the specific issue, namely that it is impossible or only insufficiently possible to remove the microplastic particles from wastewater using conventional wastewater treatment. The standard approach here is to apply the principles of coarse cleaning, biological decomposition, flotation, sedimentation and fine filtration. Due to the existing disadvantages and high process engineering complexity of these filtration processes, wastewater treatment in this manner is very cost-intensive and therefore only rarely lucrative.

Moreover, there is the process-technical limitation that these filter medium-based processes can only be used in processes in which the entirety of the solids is to be filtered out of the medium. If, rather than absolute filtration, separation or partial separation of the solids based on their physical properties is required, as is the case when filtering microplastics from a fiber suspension during paper manufacturing, these systems cannot be used since the separation criterion of such prior art systems is defined only in terms of the dimensions of the particles and not in terms of their material.

Cyclone separators therefore also play a role in the treatment of process waters and pulp suspensions in the paper industry. An important process step here that defines the paper quality and process stability is the removal of so-called low-density contamination. In its main fractions, this consists of microplastic particles (PE, PP and polystyrene foam from packaging waste) as well as hot-melt particles and waxes. Low-density contamination, with a specific density lower than that of water, is currently removed from the pulp suspension using a reverse cleaner cyclone separator. The reverse cleaners commonly used for this exhibit clear disadvantages in relation to separation efficiency and operation time efficiency, which results in direct financial losses due to production downtimes or reduced paper quality. Reverse cleaners can separate substances based on their density, which enables said plastic particles to be separated from the paper particles, to a certain, but usually not a satisfactory, degree of separation. The reverse cleaners cannot adequately remove microplastic particles, however, because the density of the particles is only slightly different to that of water, and the particles are too small in size.

The presence of these contaminants can lead to a reduction in quality of the goods being produced (e.g. paper, cardboard), and also process-technical problems, such as damage to pumps, compressors or similar assemblies due to undesired contaminants. In addition, this can also lead to environment-related economic consequences, since the removal of the contaminants can be a condition for compliance with contaminant limits (e.g. the microplastic load in wastewater from wastewater treatment plants, biomass in waste waters, Chemical Oxygen Demand (COD)/Biochemical Oxygen Demand (BOD), Persistent Organic Pollutants (POP), Adsorbable Organic Halides (AOX)).

The prior art for cyclone separators is generally defined by an identical basic design. This is characterized by a usually conical base body that has no less than three inlets and outlets. The inlet is usually located tangentially at the wider end of the cone. The outlet for the light fraction is usually located centrally on the top side of the cone, whereas the outlet for the heavy fraction is located at the tapered end of the cone. During operation, the fluid introduced for treatment is fed into the upper side of the cone, usually tangentially, and is thereby induced into a rotational flow. Driven by the constant inflow, this flow works its way downwards to the tapered end of the cyclone separator in a spiral manner. This flow path causes a free flow reversal, which results in an upward movement of a partial flow in the center of the (helical) circular flow of the fluid (vortex). This partial flow, which is characterized by a proportionally low load of heavier contaminants with higher specific densities, i.e. mass, is ejected centrally in the upper part of the cyclone separator. The fraction that has been enriched with particles with heavier specific mass is discharged at the tapered end of the cyclone separator. In cyclone separators, separation into components with different densities occurs by means of the centrifugal forces induced by the rotation. This means the greater the centrifugal forces, the higher the separation precision. The prior art defines a plurality of different design options for cyclone separators based on this long-known technology. A common feature of these without exception, however—regardless of how the general structure of the cyclone separator has been modified—is the free flow reversal in the inner vortex.

The disadvantages of known cyclone separators are attributable, in particular, to the free flow reversal in the inner vortex that results from the structural features. Since the location and intensity of the flow reversal, and therefore the separation efficiency, depend to a significant extent on the structural as well as process-technical conditions, the classic design of the cyclone separator is the reason for its sensitivity to change in external factors (e.g. volume flows, inflow-accept-reject ratios, pressure differentials, viscosity of the medium, degree of contamination). This also causes various disadvantageous flow conditions within the vortex, as a result of which a higher precision in separating phases of a fluid, and therefore a higher efficiency in separating phases of a fluid is not achieved. The lack of ability to dynamically adapt to situational conditions, in particular to changes in the mentioned external conditions, is therefore disadvantageous.

For instance, DE 936 488 discloses a centrifugal separator (cyclone dust collector) for separating microparticles of dust from gases which, due to the structural circumstances, cannot react sufficiently to changed process conditions and requirements such as, e.g., the type and properties of the phase(s) to be separated out, in order to reliably control the rotation and flow.

The object of the present invention is to at least partially overcome the disadvantages known from the prior art.

The aforementioned object is solved by a cyclone separator according to Claim 1 of the invention. Preferred embodiments of the cyclone separator are the subject of the dependent claims.

The cyclone separator according to the invention for separating at least two phases of a fluid has a base housing through which the fluid can flow in an essentially helical pattern, that has a separation chamber with an upper and a lower end, wherein the upper and lower end each respectively have a wall, and a central axis that extends between the two ends, and furthermore a central separation tube arranged inside the conical separation chamber, concentric to the central axis of the base housing, with an essentially cylindrical wall having a surface facing the inner cross-section with a first surface profile, and a surface facing away from the inner cross-section with a second surface profile. The cyclone separator according to the invention is characterized in that the base housing has at its upper end a head section with an inner radius and with at least one essentially tangentially attached inlet opening for the fluid, as well as at least one light fraction outlet opening with a cross-section and, at its lower end, at least one expansion chamber and at least one heavy fraction outlet opening.

The cyclone separator according to the invention is characterized in that the separation chamber tapers conically in the direction of the lower end at least incrementally in sections, preferably with a constant cone angle $\alpha$. This essentially equalizes the flow conditions in the vortex advantageously. As a result of this, it is possible to apply greater centrifugal forces and induce less disruptive and disadvantageous flows.

Within the meaning of the invention, "conical" means a narrowing cross-section that is essentially perpendicular to a central axis.

Within the meaning of the present invention, "fluid" encompasses any flowable, i.e. solid, gaseous and/or fluid medium. In particular, this includes fluid, gaseous and/or solid-based fluids with at least two phases, in particular such fluids whose phases differ with respect to their bulk density.

Within the meaning of the present invention, "fluid with at least two phases" means any heterogeneous mixture of at least two phases, the phases of which can be separated from one another, at least partially, by means of physical or physical-chemical methods or combinations thereof. In particular, this includes mixtures of at least two not completely miscible fluid or solid phases, or mixtures of at least one gaseous phase and at least one fluid phase and/or of at least one solid phase, as well as at least one fluid phase and of at least one solid phase, as well as aerosols, solid mixtures, foams, emulsions, dispersions and suspensions. This also includes multiphase mixtures, wherein one or more substances (secondary phase(s)) are distributed in another continuous substance (primary medium, continuous phase).

Within the meaning of the present invention, "phase" means a spatial region inside of which no sudden change in any physical value occurs and the chemical composition is homogeneous. The phases can be all or partially or singly fluid and/or solid and/or gaseous.

The phases can be educts or products, or both.

The intended separation of phases of a fluid with at least two phases can be, for example:

- fluid from fluid (e.g separating the phases of a two-phase emulsion)
- fluid from gaseous (and vice-versa)
- fluid from solid (and vice-versa)
- gaseous from fluid (and vice-versa)
- solid from solid (and vice-versa)
- solid from gaseous (and vice-versa), wherein the at least two phases are of different densities from one another, such that the at least one lighter phase is separated out via the central separation tube through the light fraction outlet opening, and the at least one heavy phase is separated out through the heavy fraction outlet opening.

The separation of phases of a fluid can primarily serve to clean or purify a substance. Therefore by means of the present invention, a fluid, solid or gaseous primary flow can be freed from a phase of undesirable substances in the other phase and/or in the other phases.

Within the meaning of the present invention, "microplastic" means any polymeric plastic particle at or below a size of approx. 5 mm, whereby those less than approx. 1 mm are of special interest for the present invention.

The cone angle α according to the present situation means the deviation from the central axis of the base housing; in particular, positive and negative angles are understood as cone angles.

According to a preferred embodiment of the cyclone separator according to the invention, the cone angle α is between approx. 0.1 and 5°, preferably between approx. 0.2 and 3°, and especially preferably between approx. 0.5 and 1.5°.

According to another preferred embodiment of the cyclone separator according to the invention, the central separation tube is essentially continuous along its length and essentially extends to the lower end of the separation chamber, wherein a gap is provided between the central separation tube and the wall of the lower end.

As a result of the modification made to the cyclone separator according to the invention, with a continuous central separation tube that essentially extends to the lower end of the separation chamber, and wherein a gap remains between the central separation tube and the wall of the lower end, surprisingly the flow reversal is suppressed in the upper regions of the cyclone separator. As a result of the rotation induced in this manner, the gravitational field is significantly increased in the region of the inlet opening of the lower end of the central separation tube, the so-called separation zone. In other words, by means of this embodiment according to the invention, the fluid to be treated is forced to pass through, in a defined manner, the entire separation chamber in a helical pattern around the central separation, thereby suppressing the formation of the inner vortex typical of conventional cyclone separators that extends centrally, with its flow in the direction of the central separation. This means that the flow reversal does not occur until the region of the separation zone where the light fraction separation occurs. Consequently, the flow reversal is positioned within the vortex in a defined manner and, advantageously, is not left subject to external factors, as in the prior art. Surprisingly therefore, on the one hand, higher gravitational forces are achieved compared to the prior art and on the other hand, zones with undefined turbulence are avoided, and thereby the separation precision and separation efficiency of the reject is significantly increased. As such, the separation processes in the present embodiment according to the invention are not only based on the basic principles of the technology of prior art cyclone separators, but rather also on those of the accelerated sedimentation and flotation induced by artificial gravitation, with a defined removal of light fraction phase(s) in the separation zone. The separation processes for removing contaminants used in the previously known prior art technology of cyclone separators are significantly improved thereby. Consequently, within the scope of the present invention, the basic principle of the cyclone separator was adopted and innovatively modified in order to be able to further clean even very clean media that are only contaminated with low levels of foreign substance, and foreign substances with specific densities close to those of the density of the medium to be cleaned and to at least partially remove the foreign substances, e.g. microparticles with minimal density difference compared to the fluid phase, such as microplastics compared to the aqueous phase.

In another preferred embodiment of the cyclone separator according to the invention, the wall of the central separation tube has radial circumferential perforations in the region of the lower half of the base housing.

This region of the wall of the central separation tube with perforations defines the zone where the light fraction and the heavy fraction of the introduced fluid that is induced to flow are separated.

In another preferred embodiment of the cyclone separator according to the invention, the perforations are essentially straight line-shaped, zigzag-shaped, serpentine-shaped, arc-shaped, helical, meander-shaped, dot-shaped, ring-shaped, oval, rectangular, square, trapezoidal, star-shaped, crescent-shaped, triangular, pentagonal and/or hexagonal and/or hybrid forms of the aforementioned shapes.

The light fraction of the introduced fluid is centrally removed from its heavy fraction through the perforations. The modification according to the invention of the size, shape, positional arrangement and distribution of the perforations on the wall of the central separation tube in the region of the lower half of the base housing enables the removal parameters for a specific light fraction to be individually controlled. For example, this allows for fine adjustment of the speed of separation and/or in the case of a solid light fraction, also allows for adjustment of the exclusion size for a solid light fraction to be separated out. Supplementarily, the surface structure of the central separation tube can also be modified according to the invention. Overall, by means of the possible modifications mentioned, the efficiency of the cyclone separator can be adjusted in a highly individualized and situationally-dependent manner.

According to another preferred embodiment of the cyclone separator according to the invention, the perforation area of the wall of the central separation tube is between approx. 50 and 1000%, preferably between approx. 75 and 200%, and especially preferably between approx. 100 and 150% relative to the cross-section of the light fraction outlet.

According to another preferred embodiment of the cyclone separator according to the invention, the first and/or the second surface profile of the cylindrical wall of the central separation tube is essentially wave-shaped, step-shaped or ramp-shaped, and/or hybrid forms of the aforementioned surface profiles.

According to another preferred embodiment of the cyclone separator according to the invention, a flow guide element extending concentrically around the central separation tube is provided on the inner wall of the base housing at the upper end of the cyclone separator, with a curved semi-circular inner wall area of the flow guide element that is essentially concave in sections, in relation to the inner volume of the lateral radius r formed by the flow guide element, said flow guide element having an essentially helical section that is essentially directly connected to the inlet opening.

Within the meaning of the invention, "helical section" means a helical and/or screw-shaped winding section.

The design of the flow guide element enables the volume flow of fluid to be tangentially introduced into the upper end of the essentially conical separation chamber with minimal flow losses and in such a way as to induce rotation. By means of this modification, the volume flow in the inside of the upper end of the separation chamber is diverted by the flow guide element such that from the first essentially helical revolution, it can rotate with near constant radial and vertical speeds around the central separation tube in the direction of the separation zone.

In another preferred embodiment of the invention, the helical section has a slope angle β that is between approx. 3 and 23°, preferably between approx. 8 and 18°, and especially preferably between approx. 12 and 14°.

Within the meaning of the present invention, "slope angle" means the angle of the inner wall surface of the helical section relative to the central axis along which an introduced fluid would independently run.

In another preferred embodiment of the invention, the helical section has a radial angle of inclination γ that is approx. +/−15°, preferably approx. +/−5°, and especially preferably approx. +/−1°.

Within the meaning of the present invention, "angle of inclination" means the angle between the inner wall surface of the base housing relative to a plane bisecting the central axis perpendicularly.

In another preferred embodiment of the invention, the ratio between the lateral radius r of the flow guide element and the inner radius of the head section is between approx. 0.04 and 1.00, preferably between approx. 0.1 and 0.7, and especially preferably between approx. 0.2 and 0.4.

In the present case, "inner radius" means the radius from the inner wall surface of the head section to the central axis of the cyclone separator.

According to another preferred embodiment of the cyclone separator according to the invention, the central separation tube is detachably connected to the light fraction outlet opening of the head section, in particular by locking, and/or detachably connected to the base of the expansion chamber, in particular by locking. According to a preferred embodiment of the present invention, the expansion chamber is constructed from at least two parts, in particular from several parts. Alternatively, the central separation tube and the head section is produced as one component. Further alternatively, the holder of the central separation tube can be detached by means of a press-/adhesively-bonded embodiment of the central separation tube.

Within the meaning of the present invention, "detachably connected" means that at least two components are joined to one another, preferably directly and/or nonpositively, especially locked or clamped, such as by means of a flanged connection, a plug connection and/or another manner that appears expedient to a skilled person.

Furthermore, the separation chamber can be detachably connected to the head section with inlet opening of the cyclone separator, e.g. by means of a clamp. Alternatively, the separation chamber and the head section with inlet opening is produced as one component.

According to yet another preferred embodiment of the cyclone separator according to the invention, the expansion chamber has on the base a central pin arranged concentrically relative to the central axis in order to receive the central separation tube, said central pin essentially extending to the height of the lower end of the central separation tube.

In another preferred embodiment of the cyclone separator according to the invention, the at least one heavy fraction outlet opening is essentially tangentially attached. In this manner, the discharge volume flow (heavy phase) is removed from the separation chamber with as minimal flow losses as possible and thereby directed into the heavy fraction outlet opening.

In another preferred embodiment of the cyclone separator according to the invention, the expansion chamber is detachably connected to the lower end of the conical separation chamber, especially by locking.

According to another preferred embodiment of the cyclone separator according to the invention, a stabilizer is provided at the transition between the separation chamber and expansion chamber for the purposes of stabilizing the central separation tube and for controlling the flow of the light fraction.

According to another preferred embodiment of the cyclone separator according to the invention, the stabilizer has a first and a second annular and essentially concentric wall, each having a surface facing the inner cross-section and a surface facing away from the inner cross-section, wherein both walls are arranged in a plane and wherein the first and/or the second wall has fins with a fin angle δ, wherein the stabilizer is detachably connected to the inner side of the base housing of the lower end by means of a radially extending perforation, especially by locking, and the first wall is locked at least with a section of the central pin of the expansion chamber.

According to another preferred embodiment of the cyclone separator according to the invention, the first wall has the fins on the surface facing away from the inner cross-section, and the second wall has the fins on the surface facing toward the inner cross-section.

According to another preferred embodiment of the cyclone separator according to the invention, the fins of the first wall and the fins of the second wall essentially do not touch.

According to another preferred embodiment of the cyclone separator according to the invention, the fins of the first wall and the fins of the second wall together form at least one bridge connection.

In another preferred embodiment of the cyclone separator according to the invention, the at least one formed bridge connection is seamless, or in another preferred embodiment is non-seamless and designed to form a gap, or according to another preferred embodiment with at least two formed bridge connections, the bridge connections are hybrid forms of seamless and non-seamless bridge connections.

According to another preferred embodiment of the cyclone separator according to the invention, the fins of the first wall and the fins of the second wall are rotatably mounted, e.g. by means of a pivot or hinge bearing.

In this manner, the fin angle δ can be flexibly adjusted to the respective process requirements.

According to another preferred embodiment of the cyclone separator according to the invention, guide elements designed to displace the fins along a circular arc movement path are provided onto which the fins of the first wall and the fins of the second wall are mounted.

According to another preferred embodiment of the cyclone separator according to the invention, the guide elements are guide rails and the fins are rotatably mounted on the guide rails about a rotational axis perpendicular to the movement path.

In this manner, the fin angle δ can be flexibly adjusted to the respective process requirements.

According to another preferred embodiment of the cyclone separator according to the invention, the fin angle δ is between approx. 5 and 90°, preferably between approx. 20 and 70°, and especially preferably between approx. 30 and 60°. Fins that form seamless bridge connections with one another have the same fin angle δ. Fins that form non-seamless bridge connections with one another can have the same or different fin angles δ.

The stabilizer serves on the one hand to stabilize the central separation tube as well as control the counterpressure and thereby the vortex rotation, and on the other hand to control the flow of the light fraction.

By adjusting the fin angle δ, which is defined as the angle between the horizontal plane and the slope of the fins, the vertical speed components, and therefore the retention time and rotation intensity in the cyclone separator, can be controlled. This makes it possible, after installation and commissioning, to adapt existing units to changing circumstances and requirements, such as, e.g. the type and properties of the phase(s) to be separated out, e.g. the microplastic load, average particle size and density, or different fluid properties by changing the fin angle δ. This can be done either by replacing a stabilizer that has fins with a fixed fin angle δ or, in the case where guide elements are present, by adjusting the fin angle δ based on the situation. Alternatively, in order to influence the flow parameters or also merely to supplementarily assist in influencing the flow parameters, flow bars can be arranged on the inner wall of the separation chamber and/or on the surface of the cylindrical wall of the central separation tube that faces the inner cross-section. The ability to influence the flow by means of the stabilizer can also be used after dimensioning and installation to respond to changing process conditions. This type of cyclone separator therefore provides a high level of customizability, which serves to significantly expand the field of application.

According to another preferred embodiment of the cyclone separator according to the invention, the stabilizer is replaceable.

Furthermore, it is within the meaning of the invention according to another preferred embodiment, that the central separation tube be designed so as to be expandable in the region of its lower end in the direction of the separation chamber. This allows the cross-section of the central separation tube to be adjusted according to the external conditions present. Corresponding modifications for designing a tube so as to be expandable are known to the skilled person and are hereby referenced. These include, e.g. the use of slightly elastic materials for the central separation tube and/or material recesses extending parallel to the central axis in the central separation tube. Furthermore, to this end the central separation tube can be constructed from two or more parts. Supplementarily to the stabilizer, such modifications serve to control/adjust the set pressure in the separation cone (pressure compensation) and thereby to stabilize the flow conditions in the central separation tube and to control the light fraction flow, e.g. to increase separation performance.

According to a preferred embodiment of the central separation tube that is designed to be expandable, a suitable fastening means can be provided in the lower region of the central separation tube to limit its circumference, such as, e.g. a flange that connects the central pin of the expansion chamber to the central separation tube.

According to another preferred embodiment of the cyclonic separator according to the invention, the base housing, the expansion chamber, and the stabilizer are produced, at least in part, from an abrasion-stable material that is selected from a group consisting of hard rubber, polyamide, fiber-reinforced polyamide, polyethylene, polypropylene, polyoxymethylene, polyethylene terephthalate, fiber-reinforced polyethylene terephthalate, polyether ether ketone, polytetrafluoroethylene, polyvinylidene fluoride, ethylene-chlorotrifluoroethylene, perfluoro alkoxyalkane copolymer, tetrafluoroethylene-hexafluoropropylene, tetrafluoroethylene-perfluoro-methylvinylether, steel, stainless steel, aluminum and/or mixtures of the same.

Besides making these individual components easy to produce, e.g. using injection molding methods, this material selection is intended to ensure maximum durability and service life.

In another preferred embodiment, the base housing, the expansion chamber, and the stabilizer are made, at least in part, from an abrasion-resistant plastic, preferably polyamide. Due to its thermoplastic properties, polyamide can be excellently formed in the injection molding process and additionally modified by thermal welding. This makes it possible to produce the relevant components in a straightforward and cost-effective manner.

According to another preferred embodiment of the cyclone separator according to the invention, the central separation tube is made of a highly stable and/or abrasion-resistant material, especially from steel, stainless steel, aluminum, magnesium, fiber-reinforced polyamide, fiber-reinforced polyethylene terephthalate, polyether ether ketone, polyetherimide, polyphenylene sulfide and/or mixtures of the same.

It is necessary for the central separation tube to be produced from a highly stable and/or abrasion-resistant material because it acts on the one hand as a stabilizing component, and on the other hand must be very rigid in order not to undergo destructive vibrations due to turbulence.

According to another preferred embodiment of the cyclone separator according to the invention, the cyclone separator is constructed from several parts.

A further object of the present invention is an injection mold for producing a base housing, an expansion chamber, and/or a stabilizer. This makes it easy to produce a cyclone separator according to the invention and/or the (central) components of a cyclone separator. This in turn makes the assembled cyclone separator maintenance and inspection-friendly, among other things. In particular, this makes it possible for the cyclone separator to be installed and maintained by a single person, with minimal need for tools and a low level of prior knowledge.

The present invention further concerns the use of the cyclone separator according to the invention for separating at least two phases of a fluid.

The invention is explained below with reference to preferred exemplary embodiments, whereby it is noted that variations and/or extensions such as are directly evident to the skilled person can also be applied to these examples. Moreover, these exemplary embodiments do not represent any limitation of the invention to the effect that variations and extensions lie within the scope of the present invention.

Figure 6:
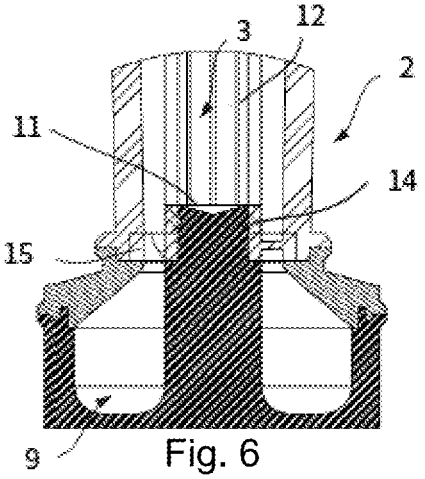
Figure 2:
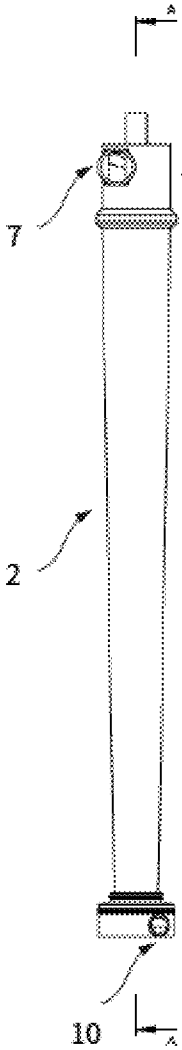
Figure 3:
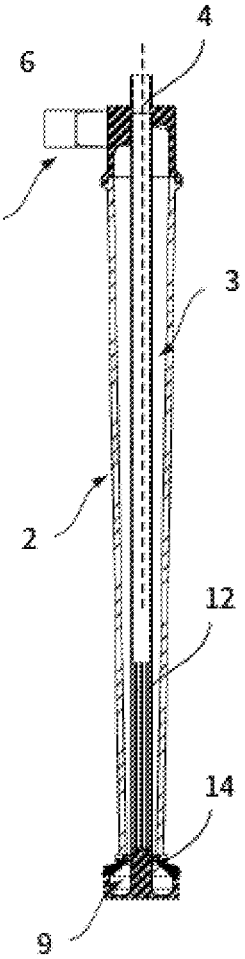
Figure 4:
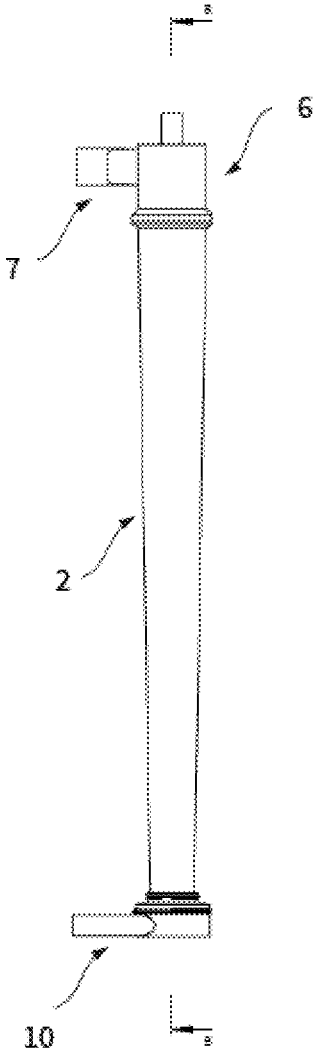
Figure 5:
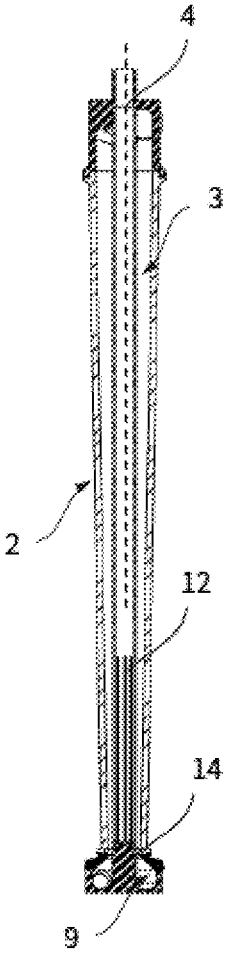
Figure 7:
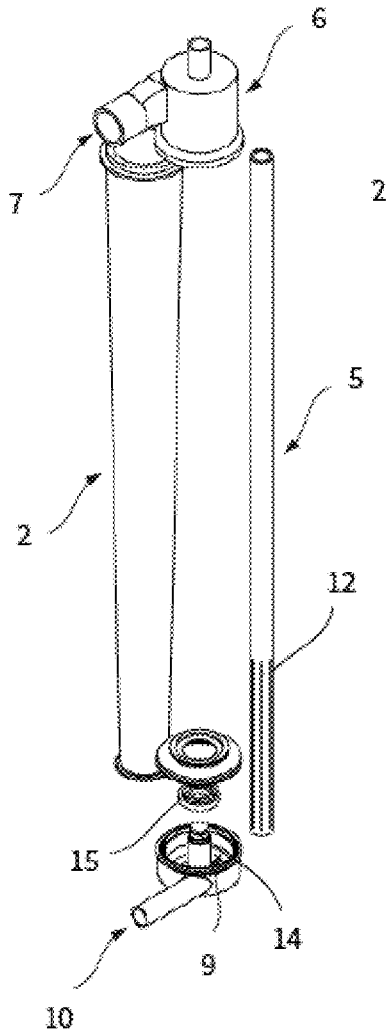
Figure 8:
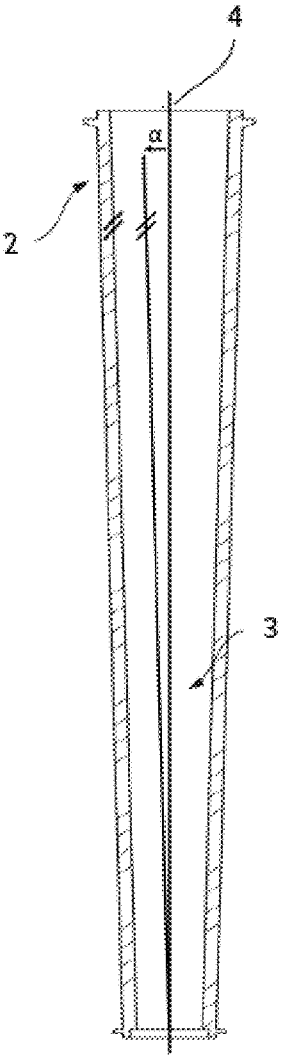
Figure 9:
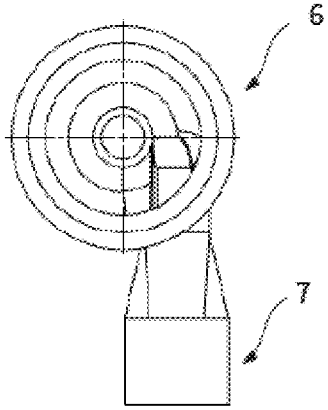
Figure 10:
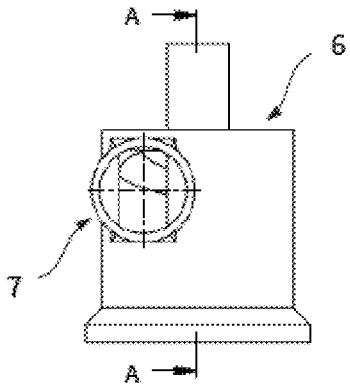
Figure 11:
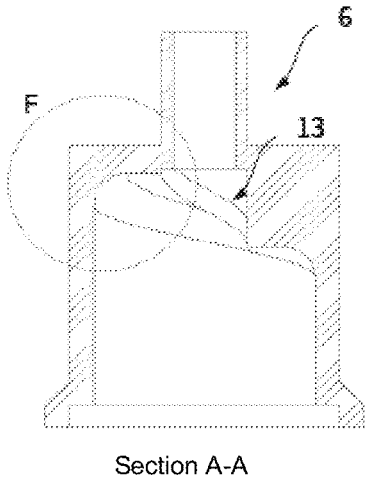
Figure 15:
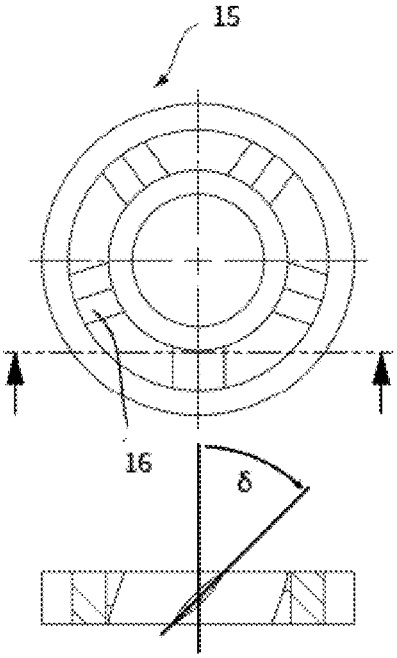
Figure 16:
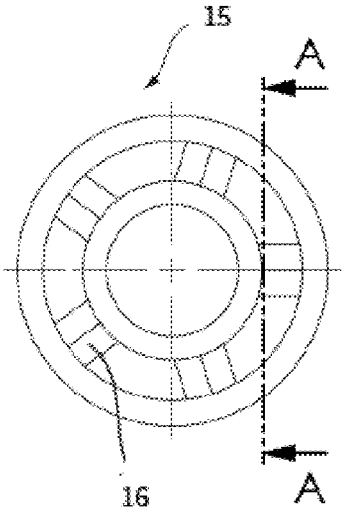
Figure 17:
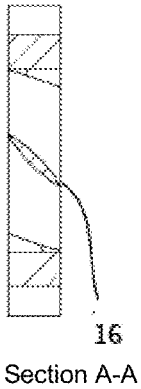
Figure 18:
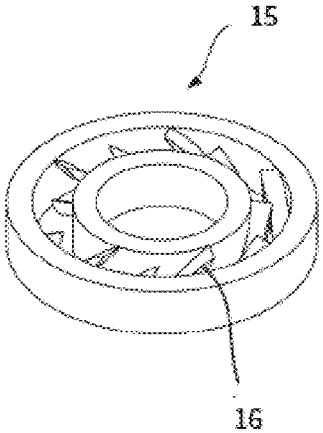
Figure 19:
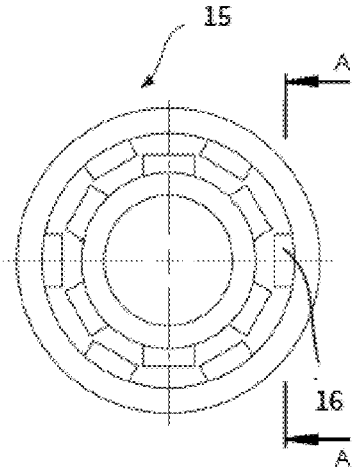
Figure 20:
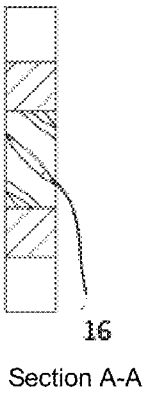
Figure 21:
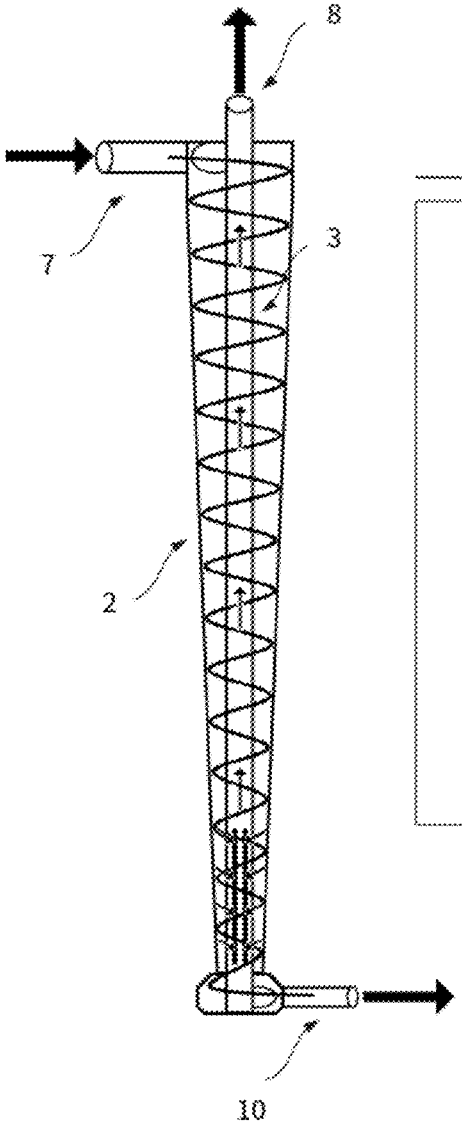
Figure 22:
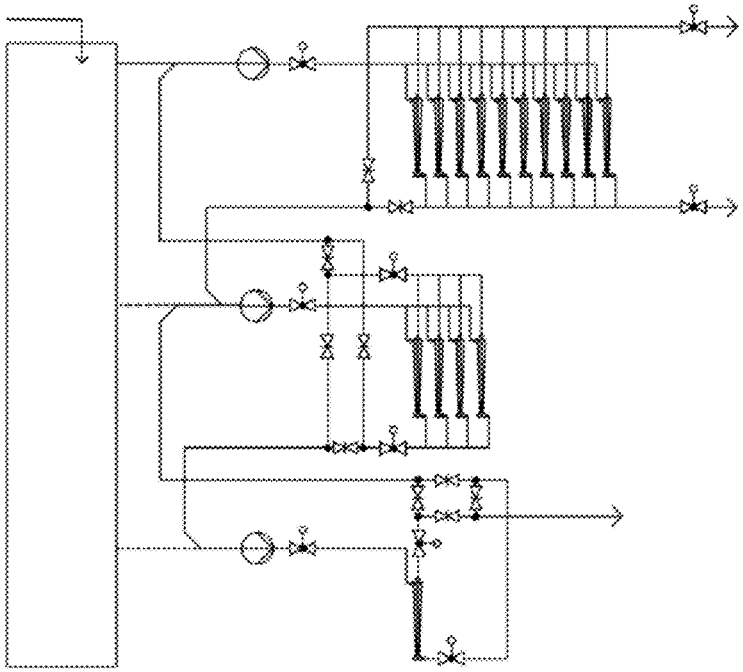

They show:

FIGS. 1 to 5: a top view and two side views of a preferred embodiment of a cyclone separator, as well as a cross-section through the base housing of a cyclone separator according to the invention in FIG. 2 and FIG. 4;

FIG. 6: an enlarged section of a cross-section through the lower end of the separation chamber in FIG. 3;

FIG. 7: an exploded drawing of a modularly constructed cyclone separator according to the invention;

FIG. 8: a cross-section through the base housing of the cyclone separator with a cone angle α according to the invention;

FIGS. 9 to 14: a top view of the bottom side, a side view thereof, three radial longitudinal sections, one with an inclination angle γ (FIG. 13), and one detail view (F) of the longitudinal section in FIG. 11 with a side radius r (FIG. 12), as well as another longitudinal section with a vertical sectional plane (H-H) of a helical section of the flow guide element and view of the vertical longitudinal section belonging thereto with a slope angle β (FIG. 14) of a preferred embodiment of a head section of a cyclone separator with flow guide element according to the invention;

FIGS. 15 to 17: two top views with fin angle δ (FIG. 15) and tangential sectional plane (FIG. 16) as well as a tangential longitudinal section (FIG. 17) through a first preferred embodiment of an inventive stabilizer for the cyclone separator according to the invention;

FIGS. 18 to 20: a perspective view and a top view, as well as a tangential longitudinal section through a second preferred embodiment of an inventive stabilizer for the cyclone separator according to the invention;

FIG. 21: a schematic illustration of the separation principle during use of the cyclone separator according to the invention;

FIG. 22: a three-stage cascade connection diagram of the cyclone separator according to the invention based on a preferred embodiment for use of the cyclone separator in industrial treatment of wastewater contaminated with microplastic particles (wastewater treatment plant);

FIGS. 23 to 28: the volume flows and the microplastic loads as a function of inlet pressure and fin angle δ of the stabilizer of a prototype of the cyclone separator according to the invention.

FIGS. 1 to 5 show a top view in FIG. 1, and a side view in FIGS. 2 and 4 of a preferred embodiment of a cyclone separator, as well as a cross-section through the base housing 2 of a cyclone separator according to the invention in FIG. 2 and FIG. 4. FIGS. 1, 2 and 4 show the base housing 2 with inlet opening 7, head section 6, central separation tube 5, central axis 4, light fraction outlet opening 8 (FIG. 21), heavy fraction outlet opening 10. It is apparent that the connections for the inlet opening 7 and light fraction outlet opening 8 are located on the head section 6. FIGS. 3 and 4 show, in addition to the elements in FIGS. 1, 2 and 4, the separation chamber 3 with upper and lower end, the head section 6 with flow guide element 13 (FIGS. 11, 13, 14), the expansion chamber 9, the central separation tube 5 with perforations 12 in the shape of straight lines, and the wall of the lower end of the separation chamber 3. The central separation tube 5 is flanged inside the head section 6. The conical separation chamber 3 is flanged to the head section 6 (with inlet opening 7) by means of a clamp (not shown here). Also apparent is the central pin 14 and the stabilizer 15 with fins (not shown in FIGS. 1-5; see fins 16 in FIGS. 15-20) arranged around the central pin 14. The expansion chamber 9 is flanged onto the lower end of the separation chamber 3 with a clamp (not shown).

FIG. 6 discloses an enlarged section of a cross-section through the lower end of the separation chamber 3 in FIG. 3. The expansion chamber 9, delimited by the central pin 14, is apparent. The stabilizer 15 is arranged around the central pin 14 and is clamped into the base housing 2 via a radially extending perforation on the inner side of the base housing 2 of the lower end, and is thereby detachably connected, and the first wall of the stabilizer 15 is clamped in with a section of the central pin 14 of the expansion chamber 9 and locked in place thereby. A gap 11 is provided between the central separation tube 5 and the wall of the lower end of the separation chamber 3.

The exemplary embodiment according to FIG. 7 shows an exploded drawing of a cyclone separator according to the invention. It can be seen that the cyclone separator is constructed from individual components in a modular manner. A stabilizer equipped with fins can be clamped in at the transition from the conical separation chamber to the expansion chamber.

Figure 12:
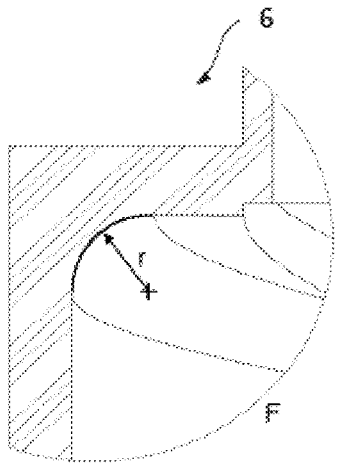
Figure 13:
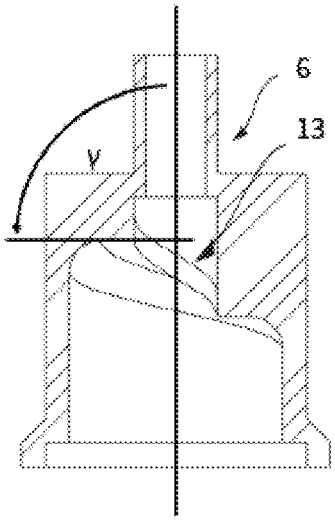
Figure 14:
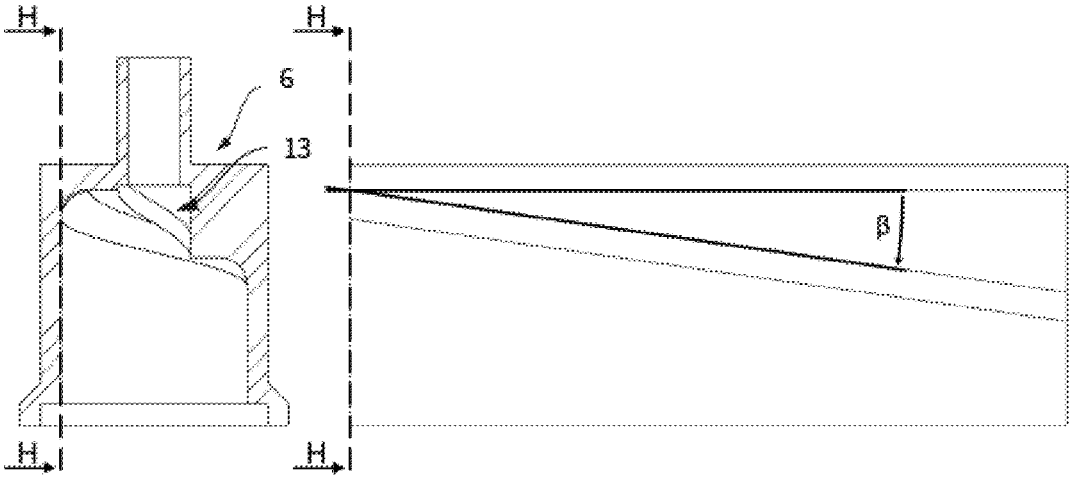

FIGS. 9 to 14 show a top view of the bottom side in FIG. 9 and a side view in FIG. 10, as well as a radial longitudinal section in FIG. 11, a detail view (F) from FIG. 11 with side radius r in FIG. 12, as well as a longitudinal section in FIG. 13 with inclination angle γ, and a radial longitudinal section in FIG. 14 with a drawn-in sectional plane (H-H) and illustrated view of the vertical longitudinal section with slope angle β of a preferred embodiment of a head section of a cyclone separator with flow guide element according to the invention.

FIGS. 15 to 17 show a top view with fin angle δ in FIG. 15, and a top view with illustrated tangential sectional plane (A-A) in FIG. 16, as well as a tangential longitudinal section in FIG. 16 through a first preferred embodiment of an inventive stabilizer for the cyclone separator according to the invention. It is apparent that the fins of the first and second wall touch, thereby forming bridge connections.

FIGS. 18 to 20 show a perspective view in FIG. 18, and a top view in FIG. 19, as well as a tangential longitudinal section in FIG. 20 through a second preferred embodiment of an inventive stabilizer for the cyclone separator according to the invention. It is apparent that the fins of the first and second wall essentially do not touch.

FIG. 21 shows a schematic illustration of the general separation principle during use of a preferred embodiment of the cyclone separator with continuous central separation tube according to the invention. The introduced multiphase fluid arrives via the inlet opening into the upper end of the separation chamber in the head section. After the radial introduction of the fluid into the cone, which tapers with a constant cone angle α in the downward direction, the fluid assumes a rotational motion. Due to gravitation and displacement, the fluid now moves in circular paths in the direction of the cone apex. There the light phase of the fluid is drawn off centrally in the region of the separation zone through the perforations of the central separation tube. As a result of the artificially generated centrifugal forces and the flow reversal in the cyclone separators according to the invention, particles with a heavier specific weight than the main medium of the fluid (heavy secondary phase) are pressed against the inner wall of the separation chamber, whereby the particles of the fluid with a lighter specific weight (light secondary phase) agglomerate in the center. This effect can be exploited by controlling the volume flow, so, that either the heavy particles (heavy secondary phase) are separated out through the heavy fraction outlet opening located at the lower end, whereby the main medium is separated out through the light fraction outlet opening, or the light particles (light secondary phase) are separated out through the light fraction outlet opening located at the upper end and the heavy main medium is separated out accordingly through the heavy fraction outlet opening.

During preliminary work involving extensive simulations taking into account various boundary conditions, the potential of the cyclone separator according to the invention, on the one hand as a functional turbomachine, and on the other hand as a separation apparatus, was analyzed and evaluated (in the present case, based on the example of water contaminated with microplastic). Tests performed in the course of this work showed that a single cyclone separator should be capable of processing volumetric flow rates between 500 l/min and 700 l/min. On analyzing the results, this design size was revealed to be advantageous, whereby the centrifugal forces lie in the magnitude between 200 $m/s^2$ and 3000 $m/s^2$, preferably between 500 $m/s^2$ and 2500 $m/s^2$, especially preferably between 700 $m/s^2$ and 2000 $m/s^2$ and in particular between 900 $m/s^2$ and 1750 $m/s^2$.

To verify the theoretical results of the separation simulations performed during the previous development work, a prototype of the cyclone separator according to the invention was designed using the SLS rapid prototyping process at a scale of 1:4.4 and produced from fiber-reinforced polyamide, then operated and evaluated at a laboratory scale.

Figure 23:
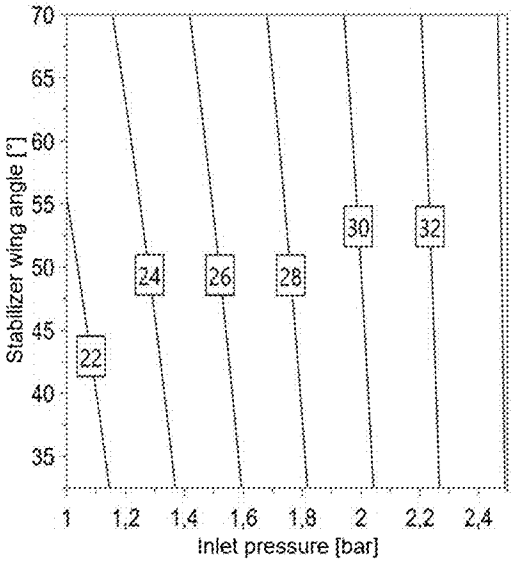
Figure 24:
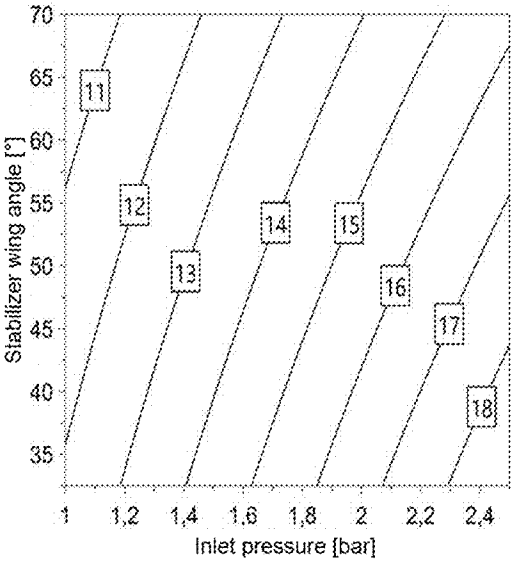
Figure 25:
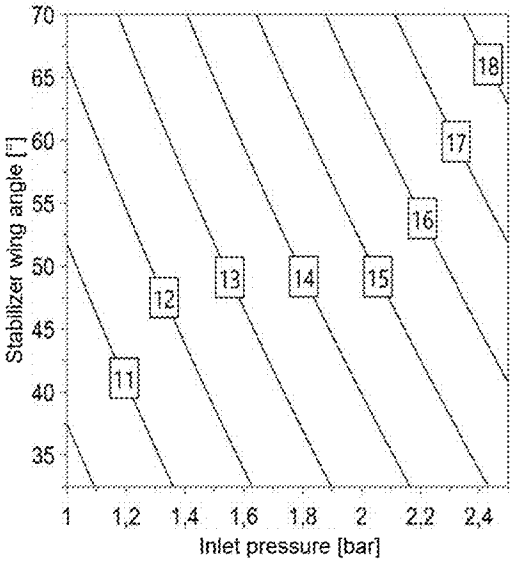
Figure 26:
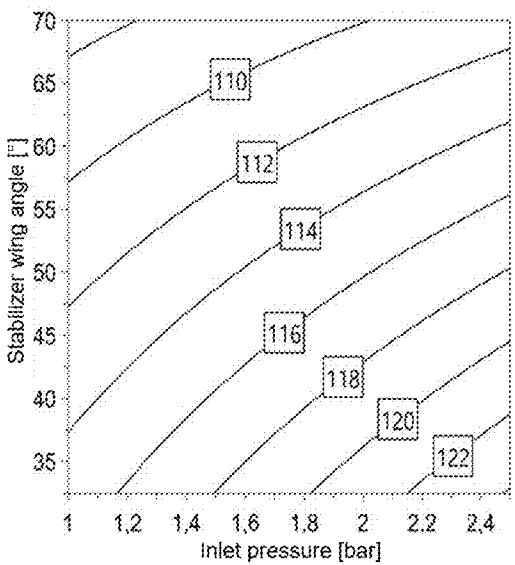
Figure 27:
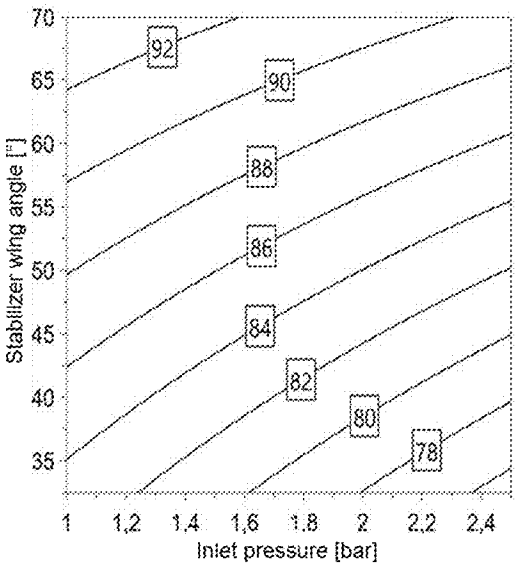
Figure 28:
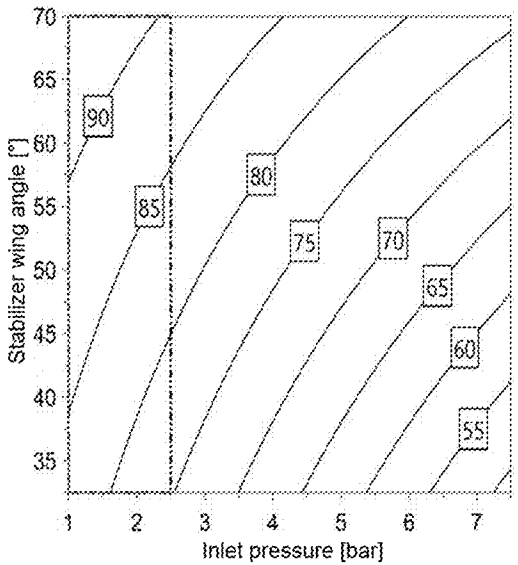

Under ideal conditions, CFD simulations of the separation efficiency of the 1:4.4 prototype showed that a separation efficiency of approx. 30% could be expected at an operating pressure of 2.5 bar. The prototype was operated as a closed circuit with a 30-liter supply. To achieve the intended maximum pressure of 2.5 bar at the inlet, which is sufficient for evaluating the separation principle, two centrifugal pumps each with a power of 800 W and a capacity of 60 l/min at 0 meters pump head were installed in-line. The inlet pressure as well as the outlet pressures to and from the prototype of the cyclone separator according to the invention were manually adjusted by means of ball valves. The volume flows of the light and heavy fraction were gravimetrically determined and with it, the respective volume flow at the inlet. The microplastic separation efficiency was also gravimetrically evaluated by means of microfiltration of the light and heavy fraction volume flows. The separation efficiency was evaluated by changing the variables of inlet pressure, and the fin angle δ of the stabilizer used. As a microplastic reference, an HDPE powder from the Pallmann company with an average particle size of <500 μm was used. As a reference substance, this powder most closely represents, in terms of particle size and material density, the contamination likely to be found in the future processes. HDPE, which has a density very close to that of water, is considered within the scope of the evaluation as the most difficult particle class to remove. The test parameters of the test series performed were:

- Inlet pressure: 1 bar; 1.6 bar; 2.5 bar
- Feed rate: 21 l/min-33 l/min
- Fin angle δ of the stabilizer: 32.5°; 45°; 57.5°; 70°
- Microplastic load: 0.1 g/l-1.0 g/I
- Microplastic particles: HDPE/~0.96 g/cm$^3$/Average size<500 μm The tests were planned and performed by means of statistical test planning and evaluation on the basis of the Umetrics Modde 10.1 program. FIGS. 23 to 28 show the results of the test as a contour plot diagram. These are based on full factorial test plans and an MLR fit of the test results. In them, the inlet pressure is shown on the x-axis and the fin angle δ of the used stabilizer on the y-axis. Depending on the figure, the various shaded areas indicate either the volumetric flow rate value in l/min, or the microplastic load in the light fraction and heavy fraction respectively in %. FIG. 23 shows the feed rate values in l/min, FIG. 24 shows the light fraction volume values in l/min, FIG. 25 shows the heavy fraction volume vales in l/min, FIG. 26 shows the light fraction load in %, FIG. 27 shows the heavy fraction load in % with applied inlet pressures of 1-2.5 bar, and FIG. 28 shows the heavy fraction load in % with high applied inlet pressures up to 7 bar. The test results show that it is advantageously possible, using an inlet pressure of just 1.0 bar with a resultant volumetric flow rate of ~21 l/min, and the 32.5° stabilizer, to reduce the microplastic load in the heavy fraction by ~16%. When the inlet pressure is increased to 2.5 bar and therefore the flow rate is increased by 50% to ~33 l/min, and using the 32.5° stabilizer, an advantageous reduction by ~23% of the microplastic load in the heavy fraction is achieved. At the same time, it is evident from all the test points that increasing the fin angle δ from 32.5° to 70° generally has the effect of reducing the microplastic separation efficiency in the heavy fraction. Conversely, this implies that a larger fin angle δ would have the effect of increasing the efficiency when separating particles with a density greater than that of water. The test results as a whole showed that the separation ability of the prototype installation, based on the 23% achieved to-date, is only ~7% less than the results of the CFD simulations in an ideal system. Considering the fact that the application used during prototype testing does not, by far, correspond to the boundary conditions of the idealized simulation, the achieved separation efficiency exceeds initial expectations. When the separation efficiency is extrapolated to an inlet pressure of 7 bar using the created MLR model (FIG. 28, bottom right), this gives a separation efficiency of 50%. This value, the so-called X50, which is defined as that particle size of which 50% is separated out, can be used to highlight the efficiency of the cyclone separator according to the invention as compared to conventional cyclone separators. This comparison gives a separation efficiency for the cyclone separator, which, measured at the X50 value, exceeds by a factor of 56 that of a comparable conventional cyclone separator.

The formula that serves as the basis for this calculation is as follows:

$$X_{50} = \left[\frac{18\pi}{16L} * \eta * \frac{(1 - R_R)}{\dot{V}_I * (\rho_P - \rho_{H_2O})}\right]^{0.5} * \left[\frac{2.3 * D_{LF}}{D_C}\right]^{0.8} * \frac{D_E^2}{0.45}$$

wherein:

| | |
|---|---|
| Length of separation cone | L = 0.280 m |
| Kinematic viscosity of water [25° C./6 bar] | η = 89.3 × 10-8 m$^2$s$^{-1}$ |
| Ratio of light fraction in feed | RR = 0.57 |
| Volumetric flow rate of feed | $V_I$ = 0.00122 m$^3$/s |
| Particle density (HDPE) | $\rho_P$ = 960.000 kg/m$^3$ |
| Fluid density (water) [25° C./6 bar] | $\rho_{H2O}$ = 997.000 kg/m$^3$ |
| LF outlet diameter | $D_{LF}$ = 0.006 m |
| Separation cone diameter | $D_C$ = 0.016 m |
| Inlet diameter | $D_{LF}$ = 0.012 m |

Surprisingly, this shows that the innovative separation principle of the cyclone separator according to the invention harbors potential previously unachieved in the prior art. On extrapolating the results to the 1:1 scale, another significant increase in efficiency can be expected, since the boundary conditions of the cyclone separator can be better matched to the idealized conditions of the simulation.

The exemplary embodiment according to FIG. 22 shows a three-stage cascade connection diagram for use of the cyclone separator according to the invention in the industrial treatment of waste waters contaminated with microplastic particles (wastewater treatment plant). It shows:

=Control valve

=Shutoff valve

=Pump

By treating contaminated wastewater and process water by means of the cyclone separator according to the invention, the microplastic load of the total volume flow is moved into the light fraction volume flow. Since, this still amounts to approx. 30% of the total volume flow in a single-stage process, this represents a significant light fraction requiring treatment, especially in larger systems. To reduce this quantity and simultaneously increase the microplastic concentration of the final reject fraction, the process engineering sequence of the overall process should be designed as a fully closed cascade. This principle can be identically extended to industrial process water applications. In this case, the wastewater and/or process water to be treated is fed into the cyclone separators according to the invention from an associated buffer tank by means of banks of high-performance centrifugal pumps connected in parallel. The cleaned fraction obtained from the first stage, which contains only 1%-3% of the initial microplastic concentration, can then be fed into the industrial process water, a chemical cleaning stage, or the outlet channel (surface water or ocean) in wastewater treatment plant applications. Further cleaning is performed in this case via the illustrated full cascade, in which the respective light fractions are fed into the next stage, and the respective heavy fractions are returned to the previous stage. This results, by the third stage, in a concentration of the microplastics and a concurrent reduction in the volume flow. This process is regulated and controlled in a fully automated manner via an integrated process control system (e.g. Siemens PCS 7). As such, only minimal external support, control, inspection and maintenance is needed from personnel. In particular, the ease of maintenance and inspection of the cyclone separator advantageously makes it possible for the cyclone separator to be installed and maintained by a single person, with minimal need for tools and minimal prior knowledge. After microplastic separation, the subsequent process step is to dispose of the microplastic using the options available to the respective wastewater treatment plant or respective industrial company. Almost all wastewater treatment plants these days are equipped with sludge desiccation stages to reduce the volume of the sludge produced; and almost all paper industry companies are equipped with reject presses. The reject fraction of the process, which contains the maximum concentration of microplastics, should be fed into either the sludge or paper industry reject stream before these desiccation stages. This enables the sludge or reject stream to serve as a filter medium during desiccation, and thereby retain the microplastics in the filter cake. Since the filtrate of these desiccation stages is returned to the wastewater treatment or process water, there is no risk that the microplastics will be released again through this process.

The invention claimed is:

1. A cyclone separator for separating at least two phases of a fluid, the cyclone separator comprising a base housing through which the fluid can flow in a helical pattern and having a conical separation chamber with an upper end and a lower end, wherein the upper end and lower end each respectively have a wall, and a central axis that extends through the base housing and between the two ends of the conical separation chamber, and furthermore a central separation tube arranged inside the conical separation chamber, extending between the two ends of the conical separation chamber, continuous in its length, and concentric to the central axis, with a cylindrical wall having a surface facing an inner cross-section with a first surface profile and a surface facing away from the inner cross-section with a second surface profile, wherein the base housing has, at the upper end, a head section with an inner radius and with at least one tangentially attached inlet opening for the fluid, as well as at least one light fraction outlet opening with a cross-section, and at the lower end, at least one expansion chamber and at least one heavy fraction outlet opening, wherein the separation chamber tapers conically, at least in sections, along the central axis in the direction of the lower end, with a constant cone angle $\alpha$ relative to the central axis, wherein at the transition between the separation chamber and the expansion chamber, a stabilizer is provided for the purposes of stabilizing the central separation tube and controlling the flow of the light fraction, and wherein the stabilizer has a first annular stabilizer wall and a second annular stabilizer wall that is concentric with the first annular stabilizer wall, each annular stabilizer wall having a surface facing toward the inner cross-section and a surface facing away from the inner cross-section, wherein both annular stabilizer walls are arranged in a plane and wherein the first and/or the second annular stabilizer wall has fins with a fin angle $\delta$, wherein the stabilizer is detachably connected to the base housing on the inner side of the base housing of the lower end, and the first annular stabilizer wall is locked at least with a section of a central pin on a base of the expansion chamber, the central pin being arranged concentrically relative to the central axis in order to receive the central separation tube, and wherein the first annular stabilizer wall has the fins on the surface facing away from the inner cross-section and the second annular stabilizer wall has the fins on the surface facing toward the inner cross-section, wherein the fins of the first annular stabilizer wall do not touch the second annular stabilizer wall and the fins of the second annular stabilizer wall do not touch the first annular stabilizer wall.

2. The cyclone separator according to claim 1, wherein the cone angle $\alpha$ is between approx. 0.1 and 5°.

3. The cyclone separator according to claim 1, wherein a gap is provided between the central separation tube and the wall of the lower end.

4. The cyclone separator according to claim 1, wherein the wall of the central separation tube has radial circumferential perforations in the region of the lower half of the base housing.

5. The cyclone separator according to claim 4, wherein the perforations are straight line-shaped, zigzag-shaped, serpentine-shaped, arc-shaped, helical, meander-shaped, dot-shaped, ring-shaped, oval, rectangular, square, trapezoidal, star-shaped, crescent-shaped, triangular, pentagonal and/or hexagonal and/or are hybrid forms of the aforementioned shapes.

6. The cyclone separator according to claim 4, wherein the perforation area of the wall of the central separation tube is between approx. 50 and 1000% relative to the cross-section of the light fraction outlet.

7. The cyclone separator according to claim 1, wherein at least one of the first surface profile or the second surface profile of the cylindrical wall of the central separation tube is wave-shaped, step-shaped or ramp-shaped, and/or hybrid forms of the aforementioned surface profiles.

8. The cyclone separator according to claim 1, wherein the central separation tube is detachably connected to the light fraction outlet opening of the head section.

9. The cyclone separator according to claim 1, wherein the central pin extends at least up to the height of the lower end of the central separation tube.

10. The cyclone separator according to claim 1, wherein the expansion chamber is detachably connected to the lower end of the conical separation chamber.

11. The cyclone separator according to claim 1, wherein the fins of the first wall and the fins of the second wall are rotatably mounted.

12. The cyclone separator according to claim 1, wherein the fin angle $\delta$ is between approx. 5 and 90°.

13. The cyclone separator according to claim 1, wherein the stabilizer is replaceable.

14. The cyclone separator according to claim 1, wherein the base housing, the expansion chamber and the stabilizer are produced, at least in part, from an abrasion-stable material that is selected from a group consisting of hard rubber, polyamide, fiber-reinforced polyamide, polyethylene, polypropylene, polyoxymethylene, polyethylene terephthalate, fiber-reinforced polyethylene terephthalate, polyether ether ketone, polytetrafluoroethylene, polyvinylidene fluoride, ethylene-chlorotrifluoroethylene, perfluoro alkoxyalkane copolymer, tetrafluoroethylene-hexafluoropropylene, tetrafluoroethylene-perfluoromethylvinylether, steel, stainless steel, aluminum and/or mixtures of the same.

15. The cyclone separator according to claim 1, wherein the central separation tube is made of a highly stable and/or abrasion-resistant material, steel, stainless steel, aluminum, magnesium, fiber-reinforced polyamide, fiber-reinforced polyethylene terephthalate, polyether ether ketone, polyetherimide, polyphenylene sulfide and/or mixtures of the same.

16. The cyclone separator according to claim 1, wherein the cyclone separator is constructed from several parts.

17. The cyclone separator according to claim 1 adapted to generate centrifugal forces in a fluid within a range of acceleration between 200 m/s2 and 3000 m/s2.

18. A method of using a cyclone separator, comprising:

selecting the cyclone separator according to claim 1; and utilizing the cyclone separator to separate at least two phases of a fluid.

19. The cyclone separator according to claim 1, wherein the separation chamber tapers conically from the head section to the expansion chamber along the central axis at the constant cone angle $\alpha$.

20. A cyclone separator for separating at least two phases of a fluid, the cyclone separator comprising:

a base housing through which the fluid can flow in a helical pattern and having a conical separation chamber with an upper end and a lower end, wherein the upper end and lower end each respectively have a wall, and a central axis that extends through the base housing and between the two ends of the conical separation chamber;

a central separation tube arranged inside the conical separation chamber, extending between the two ends of the conical separation chamber, continuous in its length, and concentric to the central axis, with a cylindrical wall having a surface facing an inner cross-section with a first surface profile and a surface facing away from the inner cross-section with a second surface profile;

wherein the base housing has, at the upper end, a head section with an inner radius and with at least one tangentially attached inlet opening for the fluid, as well as at least one light fraction outlet opening with a cross-section, and at the lower end, at least one expansion chamber and at least one heavy fraction outlet opening, wherein the separation chamber tapers conically, at least in sections, along the central axis in the direction of the lower end, with a constant cone angle $\alpha$ relative to the central axis;

wherein at the transition between the separation chamber and the expansion chamber, a stabilizer is provided for the purposes of stabilizing the central separation tube and controlling the flow of the light fraction, and wherein the stabilizer has a first annular stabilizer wall and a second annular stabilizer wall that is concentric with the first annular stabilizer wall, each annular stabilizer wall having a surface facing toward the inner cross-section and a surface facing away from the inner cross-section, wherein both annular stabilizer walls are arranged in a plane and wherein the first and/or the second annular stabilizer wall has fins with a fin angle $\delta$, wherein the stabilizer is detachably connected to the base housing on the inner side of the base housing of the lower end, and the first annular stabilizer wall is locked at least with a section of a central pin on a base of the expansion chamber, the central pin being arranged concentrically relative to the central axis in order to receive the central separation tube;

wherein the first annular stabilizer wall has the fins on the surface facing away from the inner cross-section and the second annular stabilizer wall has the fins on the surface facing toward the inner cross-section; and wherein a flow guide element extending concentrically around the central separation tube is provided on the inner wall of the base housing at the upper end of the cyclone separator, with a curved semi-circular inner wall area of the flow guide element that is concave in sections, in relation to the inner volume of the lateral radius r formed by the flow guide element, said flow guide element having a helical section that is directly connected to the inlet opening.

21. The cyclone separator according to claim 20, wherein the helical section has a slope angle $\beta$ that is between approx. 3 and 23°.

22. The cyclone separator according to claim 20, wherein the helical, section has a radial angle of inclination $\gamma$ that is approx. +1-15°.

23. The cyclone separator according to claim 20, wherein the ratio between the lateral radius r of the flow guide element and the inner radius of the head section is between approx. 0.04 and 1.00.

24. A cyclone separator for separating at least two phases of a fluid, the cyclone separator comprising:

a base housing through which the fluid can flow in a helical pattern and having a conical separation chamber with an upper end and a lower end, wherein the upper end and lower end each respectively have a wall, and a central axis that extends through the base housing and between the two ends of the conical separation chamber;

a central separation tube arranged inside the conical separation chamber, extending between the two ends of the conical separation chamber, continuous in its length, and concentric to the central axis, with a cylindrical wall having a surface facing an inner cross-section with a first surface profile and a surface facing away from the inner cross-section with a second surface profile;

wherein the base housing has, at the upper end, a head section with an inner radius and with at least one tangentially attached inlet opening for the fluid, as well as at least one light fraction outlet opening with a cross-section, and at the lower end, at least one expansion chamber and at least one heavy fraction outlet opening, wherein the separation chamber tapers conically, at least in sections, along the central axis in the direction of the lower end, with a constant cone angle $\alpha$ relative to the central axis;

wherein at the transition between the separation chamber and the expansion chamber, a stabilizer is provided for the purposes of stabilizing the central separation tube and controlling the flow of the light fraction, and wherein the stabilizer has a first annular stabilizer wall and a second annular stabilizer wall that is concentric with the first annular stabilizer wall, each annular stabilizer wall having a surface facing toward the inner cross-section and a surface facing away from the inner cross-section, wherein both annular stabilizer walls are arranged in a plane and wherein the first and/or the second annular stabilizer wall has fins with a fin angle $\delta$, wherein the stabilizer is detachably connected to the base housing on the inner side of the base housing of the lower end, and the first annular stabilizer wall is locked at least with a section of a central pin on a base of the expansion chamber, the central pin being arranged concentrically relative to the central axis in order to receive the central separation tube;

wherein the first annular stabilizer wall has the fins on the surface facing away from the inner cross-section and the second annular stabilizer wall has the fins on the surface facing toward the inner cross-section; and wherein guide elements designed to displace the fins along a circular arc movement path are provided onto which the fins of the first wall and the fins of the second wall are mounted.

25. The cyclone separator according to claim 24, wherein the guide elements are guide rails and wherein the fins are rotatably mounted on the guide rails about a rotational axis perpendicular to the movement path.

* * * * *